US005357049A

United States Patent [19]

Plummer, III

[11] Patent Number: 5,357,049

[45] Date of Patent: Oct. 18, 1994

[54] CLOSABLE ELECTRICAL SHIELDING JACKET

[75] Inventor: Walter A. Plummer, III, Santa Ana, Calif.

[73] Assignee: The Zippertubing Co., Los Angeles, Calif.

[21] Appl. No.: 64,395

[22] Filed: May 19, 1993

[51] Int. Cl.[5] ..... H01B 7/34

[52] U.S. Cl. ..... 174/36; 174/DIG. 11

[58] Field of Search ..... 174/36, DIG. 11, 117 R, 174/117 F, 117 FF

[56] References Cited

U.S. PATENT DOCUMENTS

| | | | |
|---|---|---|---|
| 2,937,664 | 5/1960 | Plummer | 174/DIG. 11 |
| 2,960,561 | 11/1960 | Plummer | 174/36 |
| 3,038,558 | 6/1962 | Plummer | 174/DIG. 11 |
| 3,089,915 | 5/1963 | Plummer | 174/36 |
| 3,357,455 | 12/1967 | Plummer | 174/DIG. 11 |
| 3,413,406 | 11/1968 | Plummer | 174/36 |
| 3,467,761 | 9/1969 | Plummer | 174/36 |
| 3,582,532 | 6/1971 | Plummer | 174/36 |
| 4,281,211 | 7/1981 | Tatum et al. | 174/36 |
| 4,409,427 | 10/1983 | Plummer | 174/36 |
| 4,572,922 | 2/1986 | Plummer | 174/36 |
| 4,734,542 | 3/1988 | Klein | 174/36 |
| 4,791,236 | 12/1988 | Klein et al. | 174/36 |

*Primary Examiner*—Morris H. Nimmo

*Attorney, Agent, or Firm*—Christie, Parker & Hale

[57] ABSTRACT

An electrical shielding jacket has a shield formed from a wire mesh strip. The cut ends of the strip are folded back onto the strip body and resistance welded in place. The jacket has a flexible casing which is closable by means of a zipper. A strip of hook and loop fastener is secured around the end of the jacket casing and is engagable to reinforce the zipper.

19 Claims, 2 Drawing Sheets

CLOSABLE ELECTRICAL SHIELDING JACKET

BACKGROUND OF THE INVENTION

The invention pertains to a shielding jacket for electrical and electronic wires and cables, and more particularly, to a novel construction of the ends of an electrical shield and an end reinforcement for the casing of the jacket.

It is common to use a shielding jacket placed over one or more conductors when either it is necessary to contain electromagnetic emissions from the conductors or to protect the conductors from external electromagnetic emissions. In accordance with Gauss' Law, it would be optimal to surround the protected conductors with a grounded conductive surface. As placing a solid metal tube around a conductor would be highly impractical, the typical shielding jacket uses some form of wire mesh electrical shield which surrounds the conductor. In a closable jacket, the shield is generally formed in an elongated, approximately rectangular shape and then wrapped around the conductor to form a tube. Some form of flexible casing similarly surrounds the shield. When such a mesh shield is used, the size and type of mesh is chosen based upon the specific ranges of frequency of the emissions which are to be shielded against. Typically, a mesh does a poor job of shielding against emissions of a wave length substantially smaller than the size of the openings in the mesh.

In a prior shielding jacket manufactured by the applicant, the rectangular shield is formed by flattening a knit wire sleeve. At the ends of the flattened sleeve the wires are cut across the ends and the two layers formed by the flattened sleeve are resistance welded together by a single pass of a rolling element resistance welder. The resistance welding serves to help prevent the mesh from fraying, which would diminish its shielding ability, as well as to prevent small pieces of wire created by the cutting from getting into and damaging either the conductors that are to be shielded or the equipment with which they are used. In the prior product a flexible polyvinyl chloride (PVC) casing in the form of a long sheet with a zipper along its edges is provided to surround the shield. A heavy braided wire conductor (braid) extends along the length of the sheet for both mechanical reinforcement and to enable a connection to a ground. The shield is disposed flat against the casing. The braid is disposed against the shield running centrally along the shield and is stitched through to the casing using a cloth thread. In operation the shield and casing are wrapped around the conductor which is to be protected. The casing is then zipped up around the shield, and the wire braid may be connected to a ground source such as a connector housing.

Despite the resistance welding of the cut end of the mesh shield, as the wire ends are still exposed, they will nevertheless have a tendency to unravel. This is so because even relatively light mechanical stimulation can break the weak bonds created by the resistance welding. It has been further observed that circumferential tension at the ends of the casing may cause the zipper to unzip and, thereby, unwrap the shield and expose the conductor.

It is therefore desirable that a flexible, closable shielding jacket be constructed so as to strengthen the mesh shield end against unraveling and to strengthen the casing end against unzipping.

SUMMARY OF THE INVENTION

There is, therefore, provided in practice of this invention according to the presently preferred embodiment, a closable electrical shielding jacket having a wire mesh electrical shield the cut ends of which are folded back onto the body of the shield and resistance welded in place. The jacket has a flexible casing which is closable by means of a zipper. A strip of hook and loop fastener is provided at each end of the jacket casing to reinforce the zipper.

BRIEF DESCRIPTION OF THE DRAWINGS

These and other features and advantages of the present invention will be appreciated as the same becomes understood by reference to the following detailed description when considered in connection with the accompanying drawings wherein.

DETAILED DESCRIPTION

Figure 1:
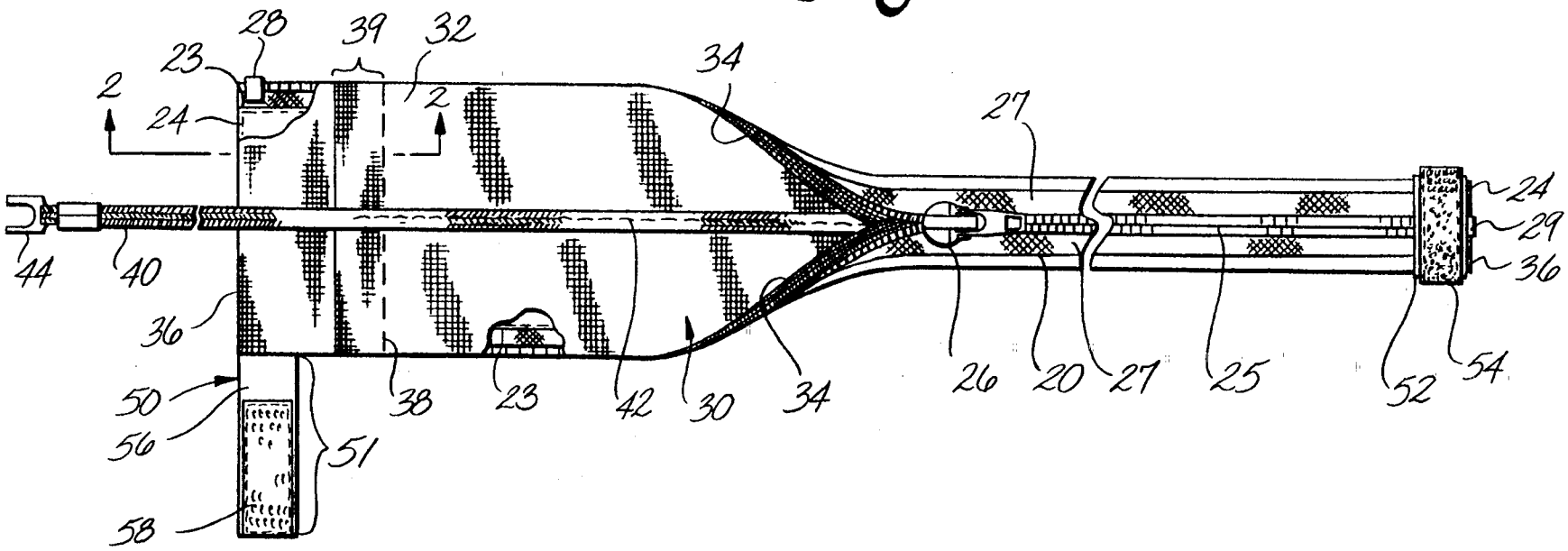
FIG. 1 is a plan view of a closable electrical shielding jacket according to a preferred embodiment of the present invention, shown partly open and partly closed.
Figure 2:
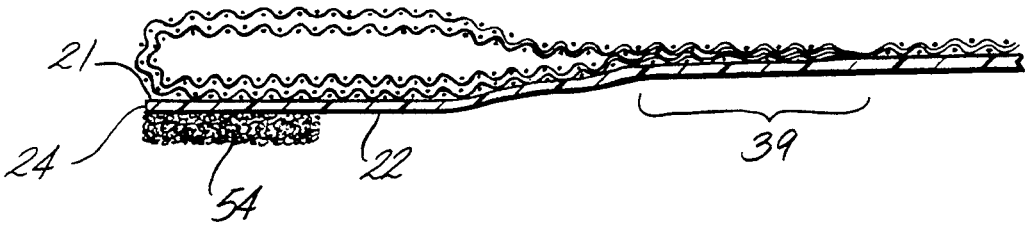
FIG. 2 is a fragmentary longitudinal cross-sectional view of the end of the jacket of FIG. 1.

To more clearly show the features of the present invention, various elements are shown with exaggerated thickness and the spacings are not drawn to scale.

The jacket has a casing 20 formed from an elongated substantially rectangular sheet of flexible polyvinyl chloride (PVC). The casing has an inner surface 21 and an outer surface 22, two elongated edges 23, and two ends 24. The casing may be formed into a tube via a zipper 25 with a slide 26 and zipper tapes 27 which are attached to the casing along the casing edges via stitching (not shown). The zipper has a top or openable end 28 and a bottom end 29.

An electrical shield 30 is positioned adjacent the inner surface of the casing. The shield is formed from a knit wire mesh tube which is flattened into a strip. The shield has a body 32, elongated edges 34, and ends 36. The edges 34 are formed by the edges of the flattened mesh strip. The ends 36 are formed by folding the strip ends 38 back onto the body 32. The strip ends are resistance welded to the body 32 using a rolling element resistance welder, to form a flattened welded zone 39. A heavy braided wire conductor (braid) 40 extends along the length of the shield body midway between the edges and is stitched through to the casing with cloth thread 42. The braid 40 extends past an end 36 of the shield and bears a connector 44.

Fastener strips 50 are positioned on the outer surface of the casing along the casing ends and secured to the casing via stitching (not shown). Each fastener strip has a free section 51 which continues beyond an edge of the casing. The outer surface 52 of each fastener strip bears fastener loops 54 adjacent to an edge of the casing, and the inner surface 56 of the strip bears fastener hooks 58 along the section 51 extending beyond the edge of the casing. Such hook and loop type fasteners are available from the American Velcro Company.

In operation the jacket is placed over any number of wires, cables or other conductors with the shield edges overlapping so as to completely encompass the conductors. The casing is closed around the shield and held by the zipper. The free sections of the fastener strips at each end of the casing are wrapped around the casing such that the hooks engage the loops thereby holding the casing closed in augmentation of the zipper. The connector on the braid may then be connected to a ground source (not shown). In addition to providing a connection to ground, the braid serves to strengthen the jacket along its length. The jacket may be opened by reversing the steps with which it was closed.

With the ends of the mesh strip folded back onto the shield body and resistance welded in place, there results a shield end that is more resistant to fraying. With the folded strip end facing the inner surface of the casing it is subjected to diminished mechanical stimulation and, additionally, is not positioned such that the strip end might come in contact with the enclosed conductors. It can also be seen that the hook and loop fastener reinforces the zipper at the ends of the casing and accordingly diminishes the likelihood that the zipper will be made to unzip when not desired to. Furthermore, the hook and loop fastener can be used to cinch the ends of the jacket tighter than is done by the zipper alone.

In the illustrated embodiment, the shield is formed of a knit steel mesh having a width of 3 inches, measured from edge to edge. The casing has a width of $2\frac{3}{8}$ inches from edge to edge which is extended to $2\frac{7}{8}$ inches by the zipper tapes. The strip ends are folded $1\frac{3}{8}$ inches back from the shield edges and the welded zone 39 measures $\frac{3}{8}$ of an inch across. In the preferred embodiment, 3/16 inch wide braid is used as well as $\frac{1}{2}$ inch wide hook and loop type fastener and a 16 tooth per inch plastic tooth zipper.

It is noted that the above dimensions are merely exemplary, being largely a matter of choice for the designer of the jacket. What is necessary is that the jacket have sufficient width as to encompass the desired conductors and that the shield be of sufficient width that its edges overlap, at least minimally, when the casing is closed. The jacket length will of course be determined by the length of conductor which is to be shielded.

While a preferred embodiment of an electrical shielding jacket has been described and illustrated herein, many other constructions will be apparent to those skilled in the art. In particular a wide variety of wire mesh structures may be used to form the shield. These range from single strips of square weave wire screening to more complex knitted and crocheted patterns and include multiple concentric flattened tubes in addition to the single flattened tube described herein. As shown in the preferred embodiment, hook and loop fastener is provided at both ends of the casing. It is noted that the more critical end is the end corresponding to the zipper top end 28, for it is this end which is subject to unzipping. Accordingly the benefits of the present invention may be substantially achieved by only having the fastener at that end. It, furthermore, is possible that a snap or other fastener could be used instead of the hook and loop fastener. It, is therefore, to be understood that within the scope of the appended claims, the invention may be practiced otherwise than is specifically described.

What is claimed is:

1. An electrical shielding jacket comprising:

a flexible elongated casing having inner and outer surfaces, two edges and two ends;

a flexible electrically conductive shield positioned adjacent the inner surface of the casing;

casing closing means extending along each casing edge for joining the two casing edges for forming a tube; and flexible and closing means secured to the casing for augmenting the casing closing means and located adjacent a casing end.

2. The electrical shielding jacket of claim 1 wherein the end closing means comprises a strip of hook and loop type fastener on the outside of the casing when formed into a tube, the hook portion of the fastener being adjacent one edge of the casing and the loop portion of the fastener being adjacent the other edge of the casing.

3. The electrical shielding jacket of claim 2 wherein the casing closing means comprises a zipper, and the strip of hook and loop type fastener is located adjacent the casing end which corresponds to the zipper top end.

4. The electrical shielding jacket of claim 2 wherein the strip of hook and loop type fastener is secured to the outer surface of the casing and located along an end of the casing.

5. The electrical shielding jacket of claim 4 wherein the strip of hook and loop type fastener extends along the end of the casing between the casing edges and has a free section continuing beyond a casing edge.

6. The electrical shielding jacket of claim 5 wherein the strip of hook and loop type fastener has an outer surface bearing loops and an inner surface which on the free section bears hooks.

7. An electrical shielding jacket comprising:

a flexible elongated casing having inner and outer surfaces, two edges and two ends;

casing closing means extending along each casing edge for joining the two casing edges for forming a tube; and an elongated electrically conductive shield adjacent the inner surface of the casing and having two edges and two ends;

wherein the shield comprises a metal wire mesh strip having a body, two edges and two ends; and wherein the strip ends are folded back onto the strip body for forming the shield ends at the fold.

8. The electrical shielding jacket of claim 7 wherein the folded strip ends are adjacent the inner surface of the casing.

9. The electrical shielding jacket of claim 7 wherein the strip ends are resistance welded to the strip body.

10. The electrical shielding jacket of claim 7 wherein the mesh strip is formed from a flattened wire mesh tube.

11. The electrical shielding jacket of claim 10 wherein the folded strip ends are adjacent the casing and are resistance welded to the strip body for avoiding loose wire ends.

12. The electrical shielding jacket of claim 11 further comprising a conductive braid extending along the length of the shield body midway between the edges and stitched through to the casing.

13. The electrical shielding jacket of claim 12 wherein the braid extends beyond an end of the casing and bears a connector.

14. The electrical shielding jacket of claim 7 further comprising:

a conductive braid extending along the length of the shield body midway between the edges and stitched through to the casing; and two strips of hook and loop type fastener secured to the casing on the outside of the casing when formed into a tube, and wherein:

the casing closing means comprises a zipper;

the wire mesh strip is formed from a flattened wire mesh tube;

the folded strip ends are adjacent the casing and are resistance welded to the strip body for avoiding loose wire ends;

one strip of hook and loop type fastener is located adjacent one end of the casing and the other strip of hook and loop type fastener is located adjacent the other end of the casing;

the hook portion of each strip of fastener is adjacent one edge of the casing and the loop portion is adjacent the other edge of the casing;

each strip of hook and loop type fastener extends between the casing edges and has a free section continuing beyond a casing edge; and each strip of hook and loop type fastener has an outer surface bearing loops and an inner surface which on the free section bears hooks.

15. A flexible electrically conductive shielding tube comprising:

a flexible tube of non-conductive sheet material;

closure means extending lengthwise along the tube for selectively opening or closing the tube;

a flexible sheet of electrically conductive material essentially completely lining the tube for electrically shielding an article within the tube; and circumferentially extending closing means overlapping the closure means at an end of the tube for securing the closure means.

16. The flexible electrically conductive shielding tube of claim 15 wherein the closing means comprises a strip of hook and loop type fastener.

17. The flexible electrically conductive shielding tube of claim 15 wherein the flexible sheet of electrically conductive material comprises a flattened wire mesh tube.

18. The flexible electrically conductive shielding tube of claim 17 wherein the flattened wire mesh tube has a body, two edges and two ends and wherein the ends are folded back onto the body and are resistance welded thereto for avoiding loose wire ends.

19. The flexible electrically conductive shielding tube of claim 15 further comprising a conductive braid extending along the length of the flattened wire mesh tube body midway between the edges and stitched through to the flexible tube of non-conductive sheet material.

* * * * *